US010065336B2

(12) United States Patent
Salzbrunn

(10) Patent No.: US 10,065,336 B2
(45) Date of Patent: Sep. 4, 2018

(54) ARTIFICIAL TURF TRIMMER

(71) Applicant: John Salzbrunn, Wildomar, CA (US)

(72) Inventor: John Salzbrunn, Wildomar, CA (US)

( * ) Notice: Subject to any disclaimer, the term of this patent is extended or adjusted under 35 U.S.C. 154(b) by 819 days.

(21) Appl. No.: 14/557,109

(22) Filed: Dec. 1, 2014

(65) Prior Publication Data

US 2015/0190885 A1 Jul. 9, 2015

Related U.S. Application Data

(60) Provisional application No. 61/924,087, filed on Jan. 6, 2014.

(51) Int. Cl.
*B26F 3/00* (2006.01)
*B26D 5/00* (2006.01)

(52) U.S. Cl.
CPC ..... *B26F 3/004* (2013.01); *B26D 5/00* (2013.01); *Y10T 83/0419* (2015.04); *Y10T 83/162* (2015.04); *Y10T 83/343* (2015.04)

(58) Field of Classification Search
CPC ..... B26F 3/004; B23K 26/362; B23K 26/421; B23K 26/083; B26D 5/00; Y10T 83/343; Y10T 83/0419; Y10T 83/162
See application file for complete search history.

(56) References Cited

U.S. PATENT DOCUMENTS 3,736,619 A * 6/1973 Zamboni ..... A47L 7/0009 15/319
3,944,452 A * 3/1976 Toland ..... D04H 11/00 156/435
4,084,763 A * 4/1978 Zamboni ..... A01G 13/0287 242/393
4,882,961 A * 11/1989 Zabinski ..... B23Q 11/0816 83/177
2001/0033782 A1* 10/2001 Conley ..... B23C 3/00 409/132
2002/0031636 A1* 3/2002 Brown ..... D06G 1/00 428/95

(Continued)

FOREIGN PATENT DOCUMENTS

CN 203045899 U * 7/2013
EP 2090151 A1 * 8/2009

OTHER PUBLICATIONS

Machine translation of CN-203045899-U, Oct. 2017.*

*Primary Examiner* — Geoffrey S Evans
(74) *Attorney, Agent, or Firm* — Innovation Capital Law Group, LLP; Vic Lin

(57) ABSTRACT

An artificial turf trimmer used to trim damaged and worn out artificial turf strands includes a load cradle to place and unwind a roll of artificial turf to be trimmed, a series of rollers set at an angle to maintain the length of the artificial turf to be trimmed tightly stretched, a brush to raise the turf strands, a vacuum pressure apparatus to maintain the turf strands raised during the trimming, a trimming mechanism that moves laterally to trim the damaged portion of the artificial turf strands, and a roll up cradle to wind the trimmed turf for further handling. The artificial turf to be trimmed moves along the different components of the artificial turf trimmer in a conveyance manner. Suitable trimming mechanisms may include a laser jet cutter or, alternatively, a water jet cutter. Alternative to the series of rollers, a cutting table may be provided.

20 Claims, 10 Drawing Sheets

(56) References Cited

U.S. PATENT DOCUMENTS

| | | | | |
|---|---|---|---|---|
| 2010/0255223 | A1* | 10/2010 | De Vries | A41G 1/009 428/17 |
| 2010/0319510 | A1* | 12/2010 | Bearden | E01C 13/08 83/155 |
| 2012/0031814 | A1* | 2/2012 | Hinkel | E01C 13/08 209/3 |
| 2013/0019987 | A1* | 1/2013 | Beauduin | D03D 27/06 139/21 |
| 2014/0291433 | A1* | 10/2014 | Owegeser | A01G 20/10 242/403 |
| 2018/0000012 | A1* | 1/2018 | Hine | A01D 43/02 |

* cited by examiner

ARTIFICIAL TURF TRIMMER

This application claims priority to and incorporates herein by reference the U.S. Provisional Patent Application Ser. No. 61/924,087 filed on Jan. 6, 2014 entitled "Artificial Turf Trimmer."

BACKGROUND OF THE INVENTION

1. Field of the Invention

The invention relates generally to the devices and methods for trimming artificial turf strands and carpet strands.

2. Description of Prior Art and Related Information

Artificial turf is known to provide a viable alternative to natural grass. It is typically made of synthetic fibers and has the appearance of natural grass.

One of the main advantages offered by artificial turf is the lower upkeep it requires. Unlike natural grass, artificial turf does not require a lawn watering system, a regular lawn mowing or sufficient sunlight to keep the grass healthy. Moreover, because of its durability, artificial turf can withstand heavy use and bad weather better than natural grass. Although more commonly used in sports arenas and fields, artificial turf is becoming more regularly used in residential and commercial properties.

Despite its advantages, artificial turf has a limited lifespan. After a period of time, wear and tear from regular use can cause artificial turf strands to wear out. Typically, the strands become discolored and its edges or tips become split. Once the artificial turf reaches the end of its life, the turf must be removed and a majority of it is disposed into landfills. A small percentage of the removed artificial turf can be recycled into other products, or sold "as is" in secondary markets for uses in dog kennels, batting cages, and so forth.

One known technique in the art uses a regular metal blade used in lawn mowers to trim the split ends of the artificial turf strands. However, because the synthetic fibers in artificial turf are typically made of plastic polymers, the friction between the plastic and the blade creates high heat that would stop the machine. Additionally, trimming the plastic turf strands using a regular lawn mower blade produces traces of abrasive silica sand that would quickly dull the metal blade.

BRIEF SUMMARY OF THE INVENTION

The present invention provides devices and methods for trimming artificial turf strands that would allow the artificial turf to be reused for its originally intended purpose. The devices and methods disclosed herein may also be used for trimming carpet strands. Thus, any reference to artificial turf strands described herein shall be understood to be applicable to carpet strands as well.

Generally, embodiments of the devices herein may include a roller assembly that unwinds a rolled segment of the artificial turf to be trimmed, straightens the turf segment and continuously moves the turf segment in a conveyance manner for trimming. According to a preferred embodiment, prior to trimming, the unrolled and straightened turf segment is moved through a brush that raises the turf strands in preparation for trimming. After the turf strands are raised from brushing, the segment continues to move along and pass through a vacuum pressure apparatus. The vacuum pressure apparatus applies vacuum pressure as the turf strand passes through and pulls the turf strands to keep them straight during trimming. Simultaneously, as vacuum pressure is applied, a trimming mechanism begins to cut the tips of the straightened turf strands as the turf segment moves. After trimming, the artificial turf segment continues to move along the conveyance to be rolled for further shipping and handling.

In one aspect, the roller assembly may further comprise a load cradle, a series of rollers, a roll up cradle, and a chain drive operated by a motor that provides a mechanism to operate the load cradle and the roll up cradle. A roll of artificial turf to be trimmed is first placed on the load cradle, unwound, pulled through the above mentioned brush and a series of rollers, and its end is placed on the roll up cradle. According to a preferred embodiment, each of the load cradle and the roll up cradle may further comprise pneumatic arms that allow for easy loading and dumping of the rolled artificial turf to be trimmed. In an alternative embodiment, the arms of the load cradle and the roll up cradle are manually adjusted. The series of rollers are provided at a vertical angle to allow the trimming mechanism to trim only the tips of the turf strands, and not shear through the turf segment and to maintain the artificial turf tightly stretched during the trimming process. In addition, the trimming mechanism may be configured to trim the turf strands horizontally or vertically in a downward direction.

In an alternative preferred embodiment, the artificial turf may be pulled through a roller assembly that is constructed at a horizontal plane and includes a cutting table, wherein the trimming mechanism is placed above the cutting table and positioned to trim the turf strands vertically in a downward direction.

In one preferred embodiment, the trimming mechanism may comprise a laser cutting mechanism that includes a motor, a gantry and a laser cutter that is laterally movable in a two dimensional plane along a track in the gantry for precise trimming. Preferably, a carbon dioxide ($CO_2$) laser is used to provide precise trimming of the turf strands by actual cutting, particularly the damaged tips. In another embodiment, a vaporization laser ablation technique is used, wherein a high repetition, high power rapid pulse focused laser beam is generated normal to the tips of the turf strands to be trimmed, heats the surface of the tips of the turf strands to a boiling point, erodes the thermoplastic material and evaporates the undesired tips of the turf strands.

In yet another preferred embodiment, the trimming mechanism may comprise a water jet cutting mechanism that includes a motor, a gantry and a water jet cutter that is laterally movable in a two dimensional plane along a track in the gantry. While the principle of operation is similar to the laser cutting mechanism, this embodiment provides another advantage in that it reduces heat affected zone that could potentially change the extrinsic or intrinsic properties of the artificial turf.

A programmable logic controller (PLC) is preferably provided to control the entire operation of the artificial turf trimmer.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
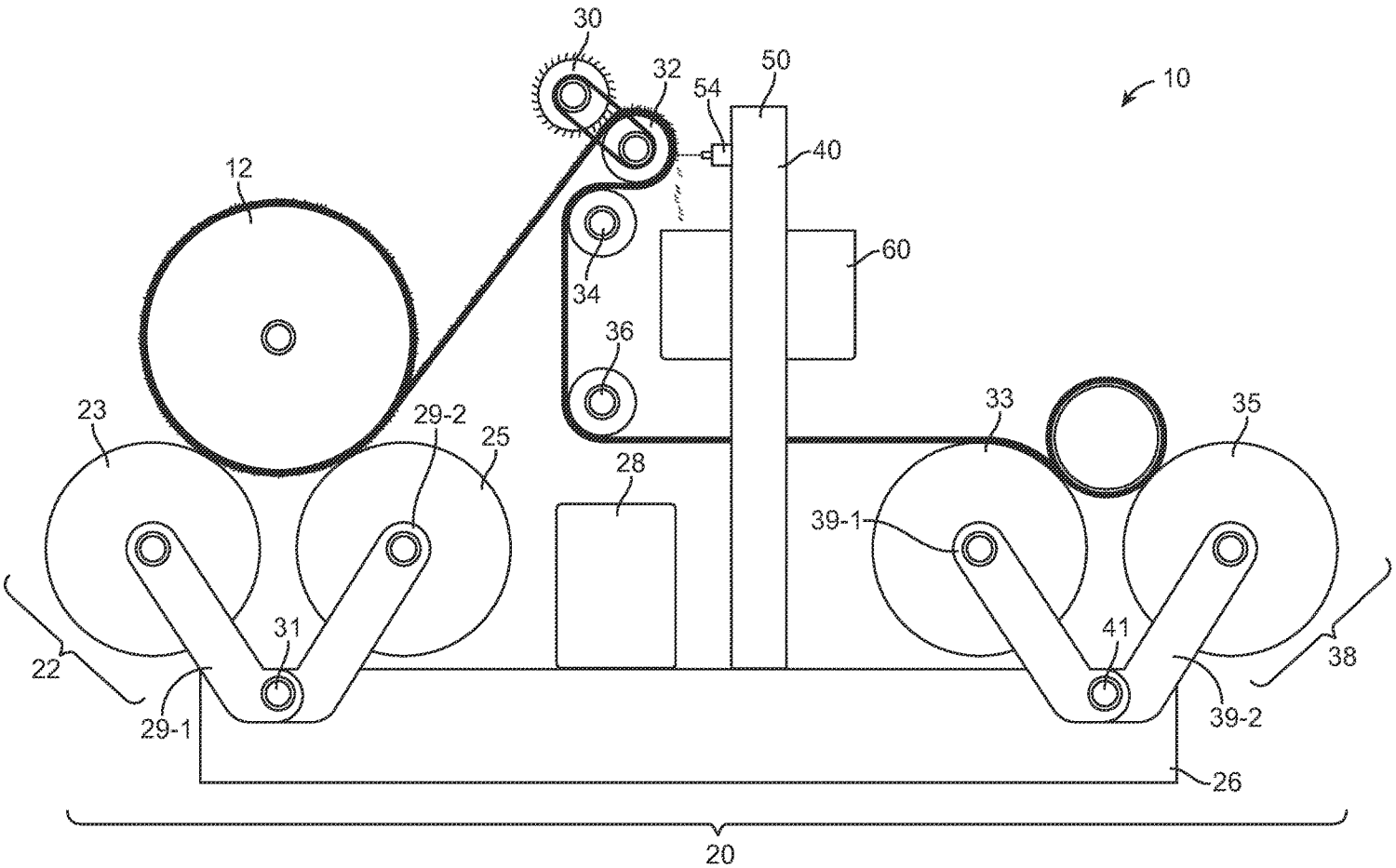
FIG. 1 is a side view of a preferred embodiment of an artificial turf trimmer wherein a roller assembly is constructed at a vertical angle and a trimming mechanism is oriented horizontally.
Figure 2:
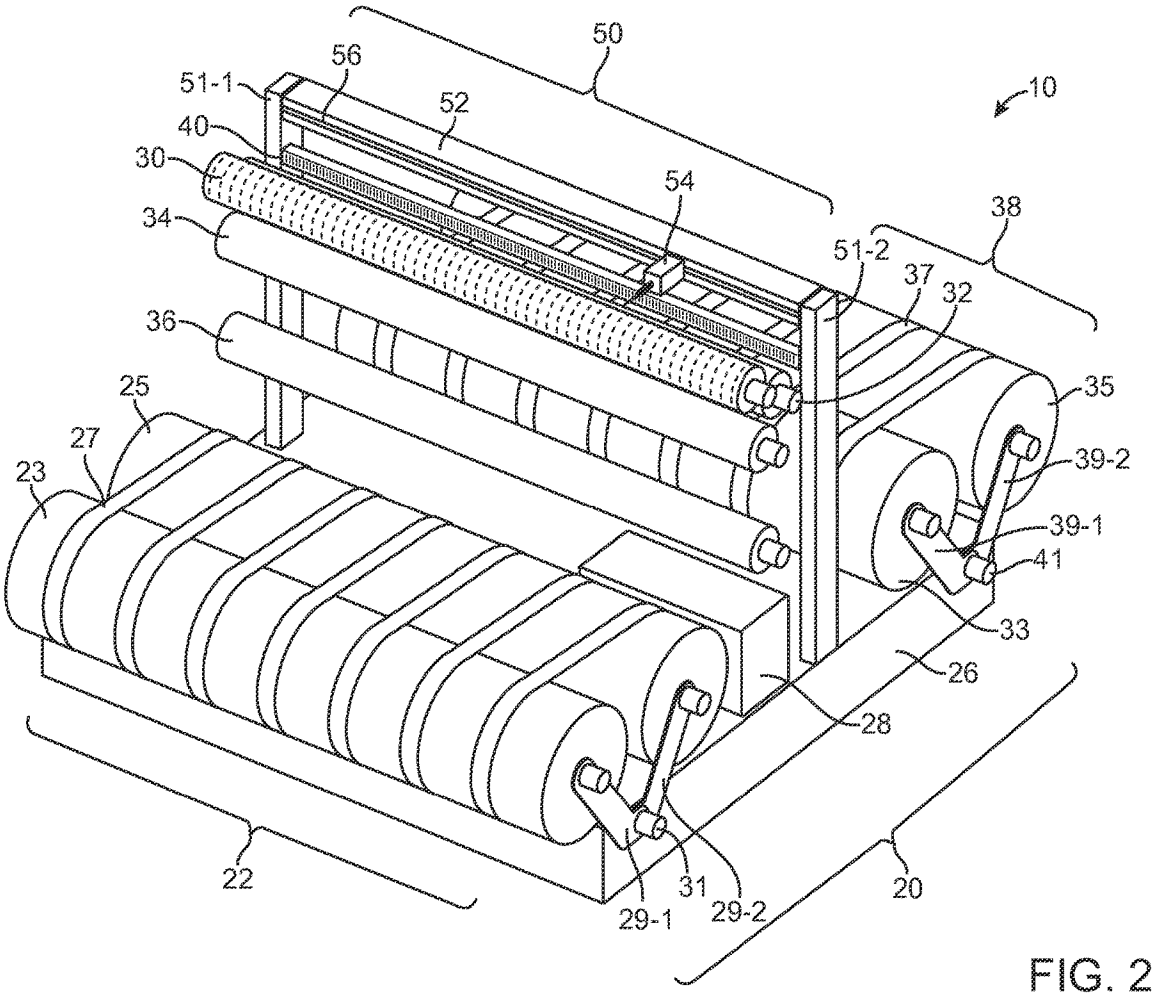
FIG. 2 is a perspective view the preferred embodiment of the artificial turf trimmer wherein the roller assembly is constructed at a vertical angle and the trimming mechanism is oriented horizontally.
Figure 3:
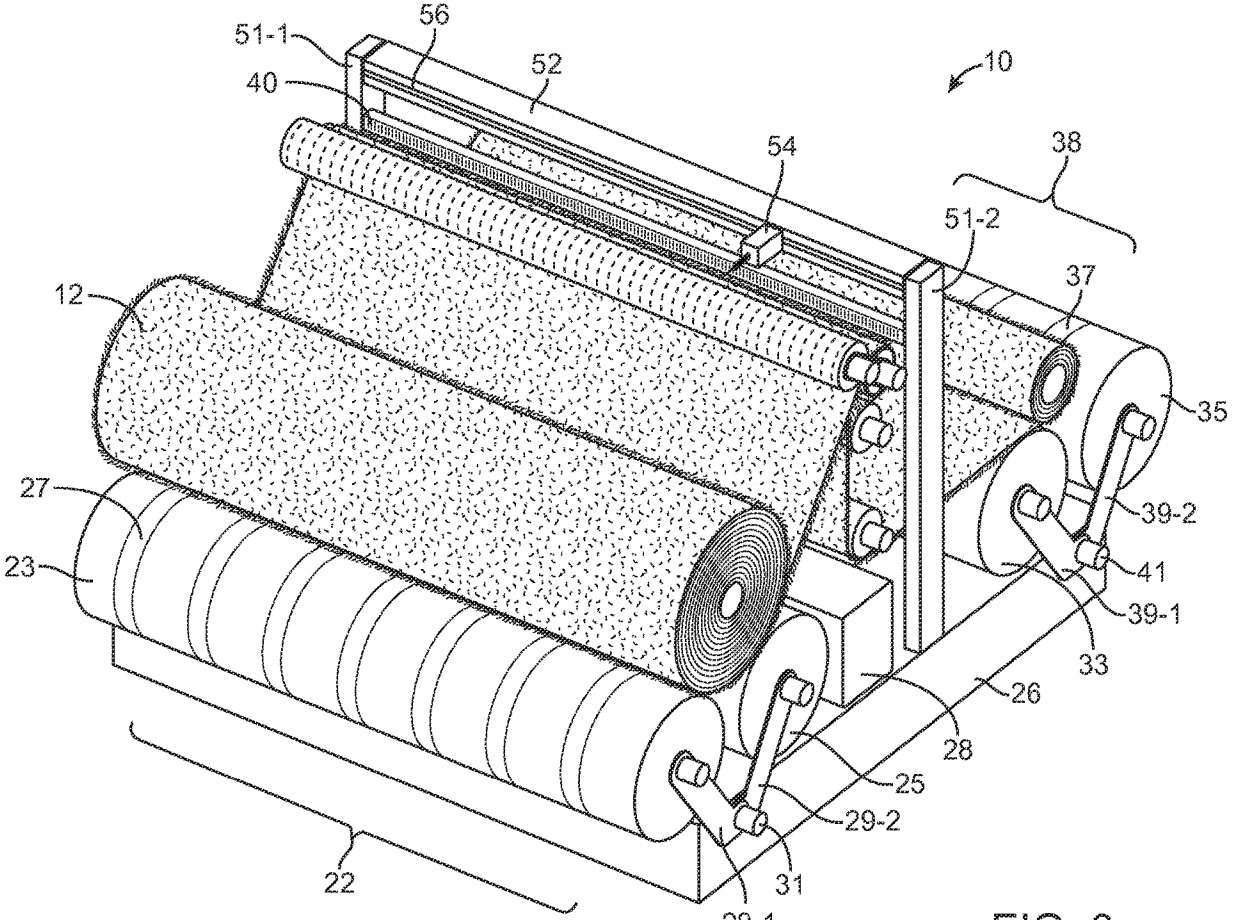
FIG. 3 is another perspective view the preferred embodiment of the artificial turf trimmer with artificial turf, wherein the roller assembly is constructed at a vertical angle and the trimming mechanism is oriented horizontally.

FIGS. 1-3 illustrate a first preferred embodiment of an artificial turf trimmer designated by a reference numeral 10. In this embodiment, the artificial turf trimmer 10 generally may comprise a roller assembly 20, a brush 30, a vacuum pressure apparatus 40, and a trimming mechanism 50. In one embodiment, a scrap bin 60 to collect debris may be provided.

As illustrated, the roller assembly 20 preferably comprises a load cradle 22, a first vertical roller 32 connected to the brush 30, a second vertical roller 34, a third vertical roller 36, a roll up cradle 38, a chain drive 24 (not shown) housed inside a chain drive housing 26 to mechanically rotate the load cradle 22 and the roll up cradle 38, and a motor 28 to supply power to the chain drive 24.

According to the preferred embodiment, a rolled artificial turf 12 to be trimmed is first placed on the load cradle 22. As shown in FIGS. 2-3, the load cradle 22 may further comprise a first load cradle roller 23, a second load cradle roller 25, and a plurality of load cradle belts 27 wound around both the first load cradle roller 23 and the second load cradle roller 25. The first load cradle roller 23 and the second load cradle roller 25 are further connected by a first pair of load cradle arms 29-1 and 29-2 on one end, and a second pair of load cradle arms 29-3 and 29-4 (not shown) on the other end. The load cradle arms 29-1 and 29-2 (as well as the load cradle arms 29-3 and 29-4 not illustrated in the drawings) are independently movable relative to each other and rotatable around a first axis 31. Consequently, the distance between the first load cradle roller 23 and the second load cradle roller 25 can be adjusted to allow various rolled artificial turfs 12 of different diameters to be securely placed on the load cradle 22. For instance, a larger roll of artificial turf 12 to be trimmed would require a farther distance between the first load cradle roller 23 and the second load cradle roller 25. On the other hand, a smaller roll of artificial turf 12 to be trimmed would require a closer distance between the first load cradle roller 23 and the second load cradle roller 25. Further, as each load cradle arm is independently movable, the load cradle arms 29-1, 29-2, 29-3 and 29-4 may be shuttled forward or backward for positioning, pivoted for squaring the rolled artificial turf 12, and lowered to allow easy loading of the rolled artificial turf 12 onto the load cradle 22. In a preferred embodiment, the load cradle arms 29-1, 29-2, 29-3 and 29-4 are pneumatically controlled. In an alternative embodiment, the load cradle arms 29-1, 29-2, 29-3 and 29-4 are manually adjusted by hand.

Similarly, the roll up cradle 38 may further comprise a first roll up cradle roller 33, a second roll up cradle roller 35 and a plurality of roll up cradle belts 37 wound around both the first roll up cradle roller 33 and the second roll up cradle roller 35. The first roll up cradle roller 33 and the second roll up cradle roller 35 are further connected by a first pair of roll up cradle arms 39-1 and 39-2 on one end, and a second pair of roll up cradle arms 39-3 and 39-4 (not shown) on the other end. Similar to the load cradle 22, the roll up cradle arms 39-1 and 39-2 (as well as the load cradle arms 39-3 and 39-4 not illustrated in the drawings) are independently movable relative to each other and rotatable around a second axis 41. Thus, the distance between the first roll up cradle roller 33 and the second roll up cradle roller 35 can be adjusted to allow various artificial turfs 12 of different diameters to be rolled and securely placed on the roll up cradle 28 after the damaged tips of the artificial turf 12 are trimmed. For instance, a larger roll of trimmed artificial turf 12 would require the first roll up cradle roller 33 and the second roll up cradle roller 35 to be farther apart. On the other hand, a smaller roll of trimmed artificial turf 12 would require the first roll up cradle roller 33 and the second roll up cradle roller 35 to be closer together. Further, as each roll up cradle arm is independently movable, the roll up cradle arms 39-1, 39-2, 39-3 and 39-4 may be shuttled forward or backward and lowered to allow easy unloading of the trimmed artificial turf 12 for further handling and packaging. In a preferred embodiment, the roll up cradle arms 39-1, 39-2, 39-3 and 39-4 are pneumatically controlled. In an alternative embodiment, the roll up cradle arms 39-1, 39-2, 39-3 and 39-4 are manually adjusted by hand.

According to a preferred embodiment, the trimming mechanism 50 may comprise a gantry 52 supported by a pair of tall vertical beams 51-1 and 51-2, and a cutting apparatus 54. Preferably, the motor 28 supplies power to the gantry 52. The gantry 52 may include a track 56, wherein the cutting apparatus 54 may move laterally in two dimensional plane and trim across the width of the artificial turf 12 during the trimming process. In one preferred embodiment, the cutting apparatus 54 may comprise a laser cutter. According to the preferred embodiment, the laser cutter may further comprise a carbon dioxide ($CO_2$) laser, wherein a beam of infrared light provides precise trimming of the turf strands by actual cutting of the strands. In another embodiment, a Galvo vaporization laser is used, wherein a high repetition, high power rapid pulse laser curtain is generated normal to the tips of the turf strands to be trimmed, heats the surface of the tips of the turf strands to a boiling point, erodes the thermoplastic material and evaporates the undesired tips of the turf strands. In yet another preferred embodiment, the cutting apparatus may comprise a water jet cutter. As shown in FIG. 1, in this first preferred embodiment of the artificial turf trimmer 10, the cutting apparatus 54 trims the damaged tips of the artificial turf 12 in a horizontal direction.

Preferably, a programmable logic controller (PLC) is provided to control the entire operation of the artificial turf trimmer 10. For instance, the PLC may concurrently monitor and control the machine runtime, the speed of the brush 30, the speed of the roller assembly 20, the pneumatic movements (lowering, raising or shuttling forward and backward) of the load cradle arms 29-1, 29-2, 29-3 and 29-4 and the roll up cradle arms 39-1, 39-2, 39-3 and 39-4, the trimming speed of the cutting apparatus 54 and any other variables. According to a preferred embodiment, the PLC may allow a user to input the length of the artificial turf trimmer 12 to be trimmed to determine a proper runtime, or manually operate the artificial turf trimmer 10 according to various preset programs and settings.

Having described the various components of the first preferred embodiment of the artificial turf trimmer 10 in greater details, the preferred principles of operation of the artificial turf trimmer 10 can now be further understood by referring to the following description.

Prior to initiating the artificial turf trimmer 10, the artificial turf 12 is loaded onto the load cradle 22. One end of the artificial turf 12 is then pulled through the brush 30 and the first vertical roller 32 at an angle, wrapped around the second vertical roller 34 and the third vertical roller 36 to ensure that the artificial turf 12 remains tightly stretched during trimming, and placed on the roll up cradle 38.

Subsequently, the PLC is then initiated to set the trimming program and activate the motor 28 and the chain drive 24. The plurality of roll up cradle belts 37 and the plurality of load cradle belts 27 begin to simultaneously move in the same direction and rotate the first and second load cradle rollers 23 and 25, as well as the first and second roll up cradle rollers 33 and 35. As a result, the end of the artificial turf 12 on the roll up cradle 38 begins to roll and pull the rest of the artificial turf 12 through the artificial turf trimmer 10. According to a preferred embodiment, the PLC indexes the artificial turf 12 one inch at a time to ensure that the artificial turf 12 remains tightly flat and the turf strands straight during the trimming process.

The artificial turf 12 moves in a continuous, conveyance manner and passes through the brush 30 and the first vertical roller 32. Preferably, the brush 30 is preset to rotate in the opposite direction of the artificial turf 12. Consequently, the strands of the artificial turf 12 become raised after being brushed by the brush 30.

As the artificial turf 12 continues to move along, it passes by the vacuum pressure apparatus 40 which applies vacuum to pull the raised turf strands to keep them straight, as well as to remove debris and smoke. Working in conjunction with the rollers, the vacuum apparatus 40 also maintains the artificial turf 12 tightly flat as it is being pulled. According to one embodiment, the vacuum apparatus 40 may comprise an elongated rectangular trough having a width of 0.25 inches to 0.5 inches and a length of 15 feet.

Simultaneously, while the strands of the artificial turf 12 are being pulled by the vacuum pressure, the cutting apparatus 54 begins to laterally move back and forth along the slot 56 and trim the damaged strands of the artificial turf 12.

In the embodiment that utilizes the laser cutter as the cutting apparatus 54, the trimming is preferably done by the carbon dioxide ($CO_2$) laser, wherein a beam of infrared light precisely cuts the tips of the strands in a very small cutting area. In this technique, the artificial turf 12 must remain as flat as possible.

In another embodiment, the Galvo vaporization laser is used, wherein a high repetition, high power, rapid pulse laser curtain is generated normal to the tips of the turf strands to be trimmed, heats the surface of the tips of the turf strands to a boiling point, erodes the thermoplastic material and evaporates the undesired tips of the turf strands. This embodiment offers the advantages of faster cutting time, precise cutting, reduction of material warping during cutting, and less byproduct debris.

In the alternative embodiment that utilizes a water jet cutter, the debris of the artificial turf 12 is collected in the scrap bin 60. While the principle of operation is similar to the laser cutter, this embodiment reduces heat affected zone that could potentially change the extrinsic or intrinsic properties of the artificial turf 12.

In yet another embodiment, other laser ablation techniques known in the art may also be utilized.

The artificial turf 12 with trimmed strands then continues to be pulled and rolled at the roll up cradle 38. After the entire artificial turf 12 has been trimmed, the now rolled up artificial turf 12 is then unloaded from the roll up cradle 38 for further handling.

Figure 4:
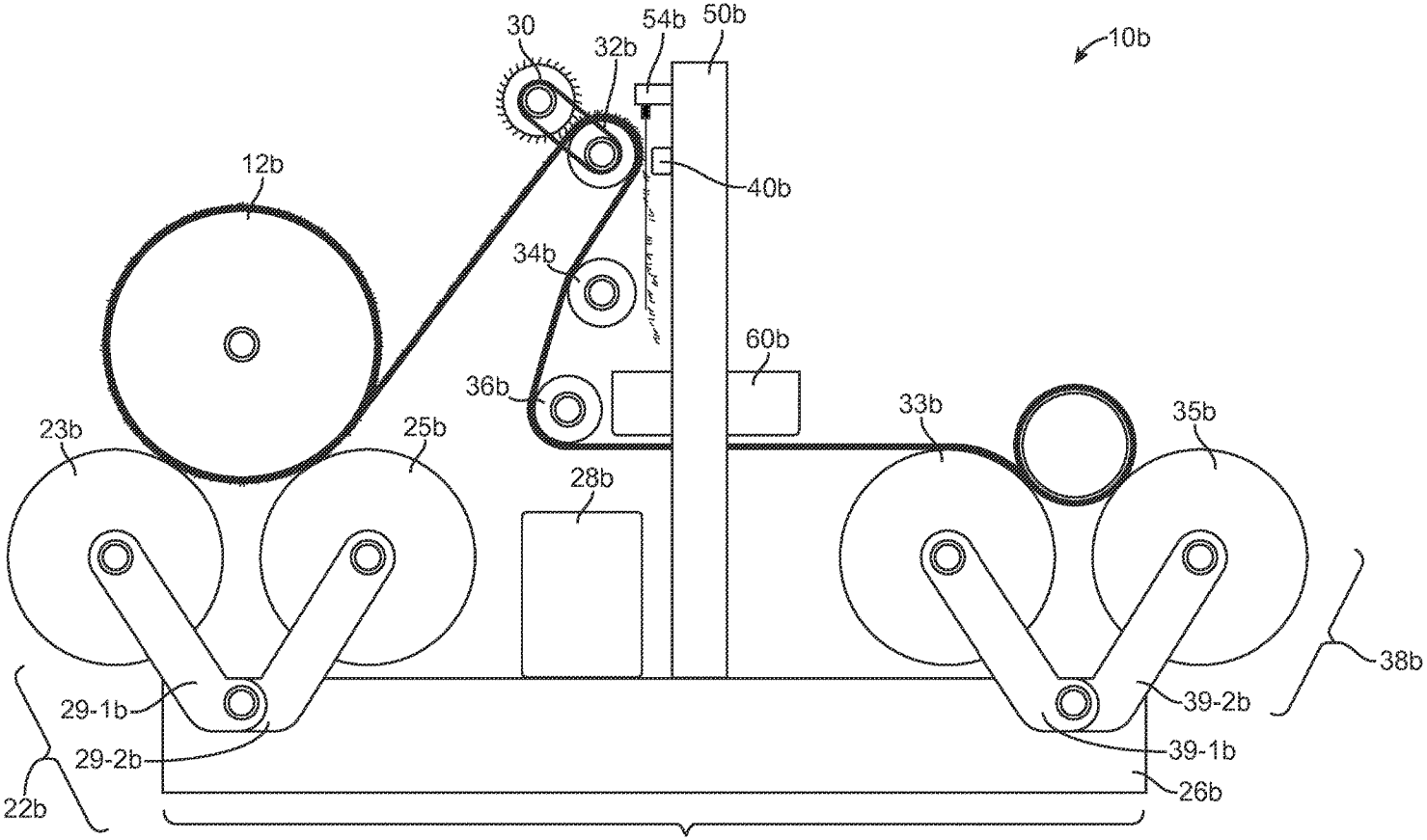
FIG. 4 is a side view of an alternative preferred embodiment of an artificial turf trimmer wherein a roller assembly is constructed at a vertical angle and a trimming mechanism is oriented vertically.
Figure 5:
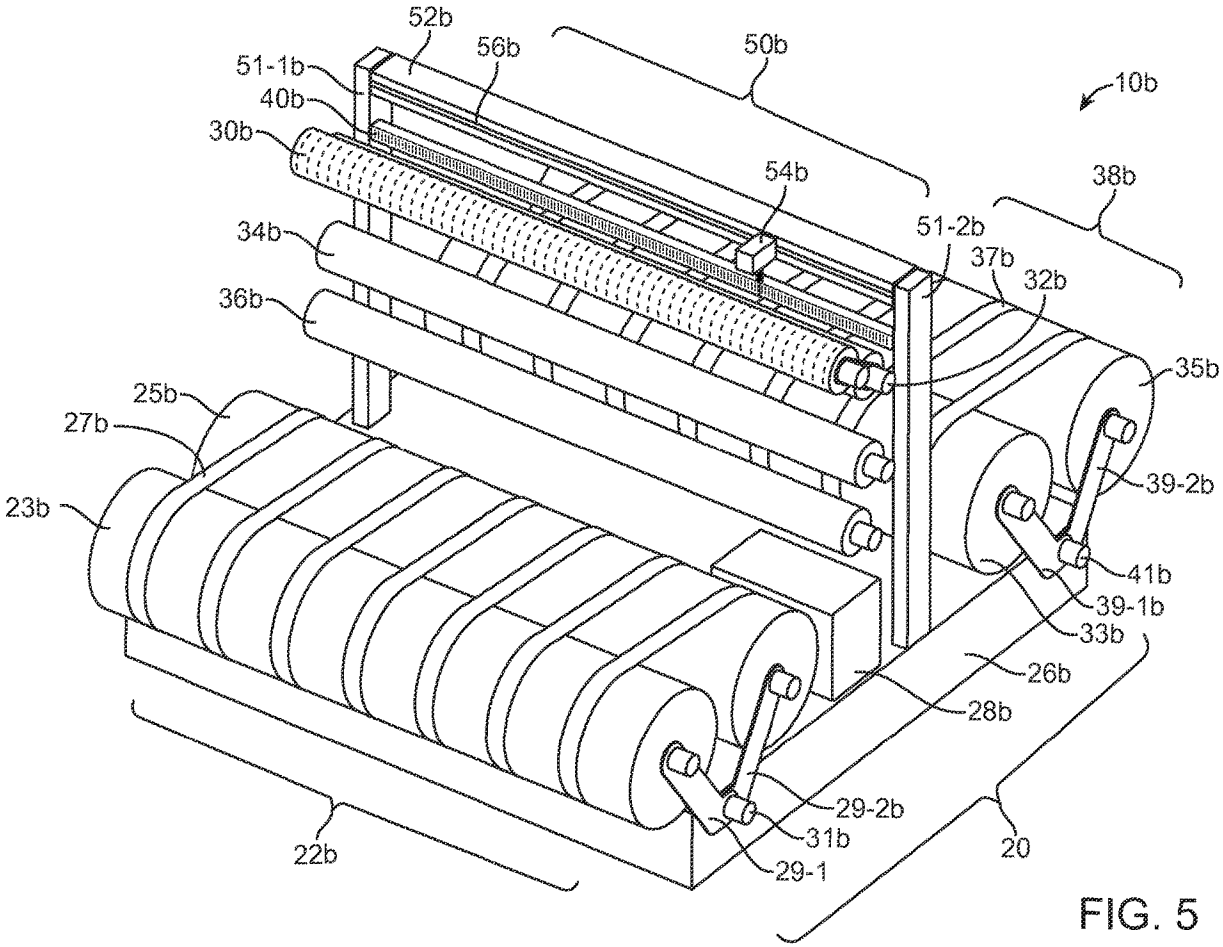
FIG. 5 is a perspective view the alternative preferred embodiment of the artificial turf trimmer wherein the roller assembly is constructed at a vertical angle and the trimming mechanism is oriented vertically.
Figure 6:
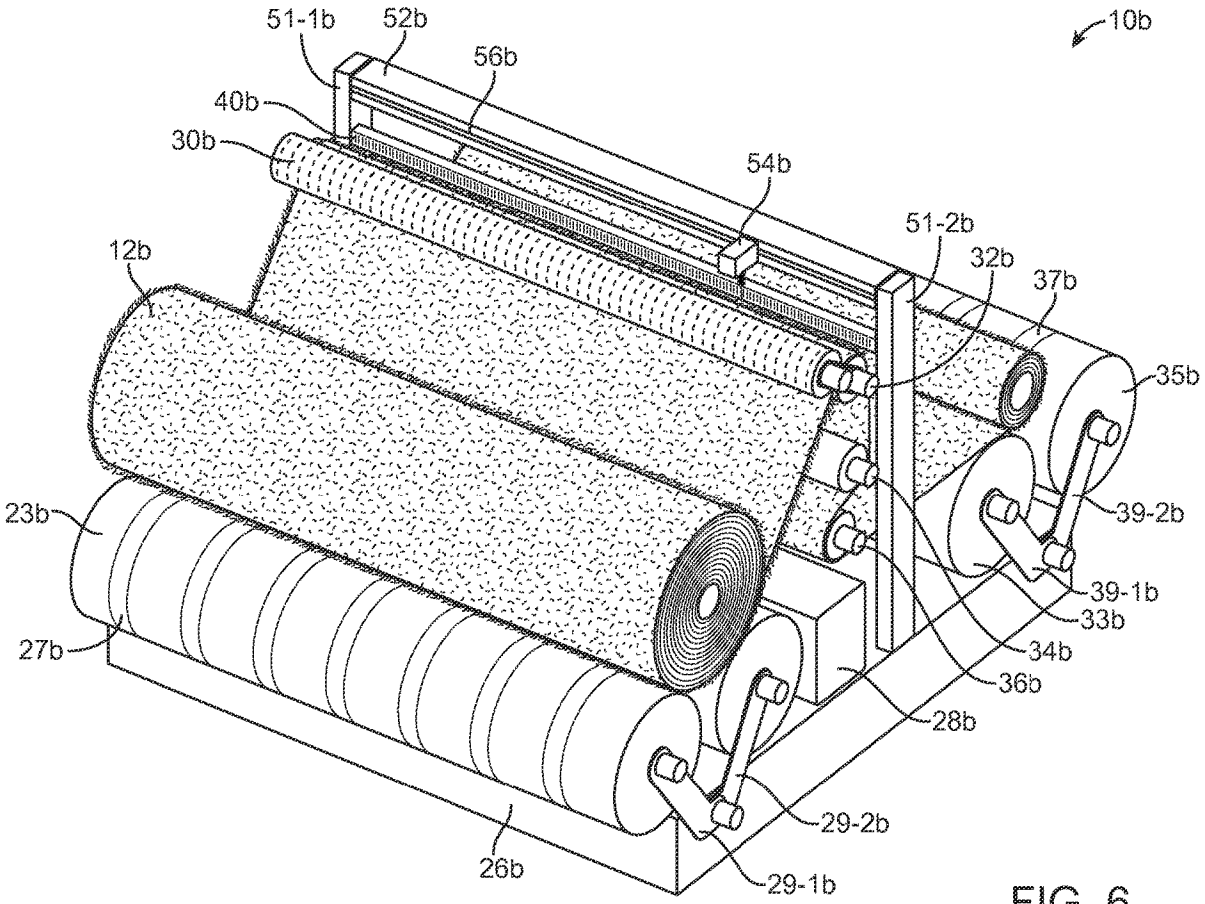
FIG. 6 is another perspective view the alternative preferred embodiment of the artificial turf trimmer with artificial turf, wherein the roller assembly is constructed at a vertical angle and the trimming mechanism is oriented vertically.

FIGS. 4-6 illustrate a second preferred embodiment of an artificial turf trimmer designated by a reference numeral 10*b*, where elements of similar structure are designated by the same reference numerals, followed by the lower case "b."

As shown in the figures, the second preferred embodiment of the artificial turf trimmer 10*b* may comprise similar components, and may be substantially similar to the first preferred embodiment of the artificial turf trimmer 10 in structural configuration and principles of operation. However, as shown in FIG. 4-6, the cutting apparatus 54*b*'s aperture in the artificial turf trimmer 10*b* is oriented in a downward direction, such that the cutting apparatus 54*b* trims the damaged tips of the artificial turf 12*b* in a vertical (downward) direction.

In the embodiment that utilizes the laser cutter as the cutting apparatus 54*b*, the trimming is preferably done by using the high power, $CO_2$ laser to cut the tips of the artificial turf 12*b* as described above. The debris of the artificial turf 12*b* is collected in the scrap bin 60*b*. Alternatively, the Galvo laser ablation technique described above may also be used. In yet another alternative embodiment, other laser ablation techniques known in the art may also be used.

Figure 7:
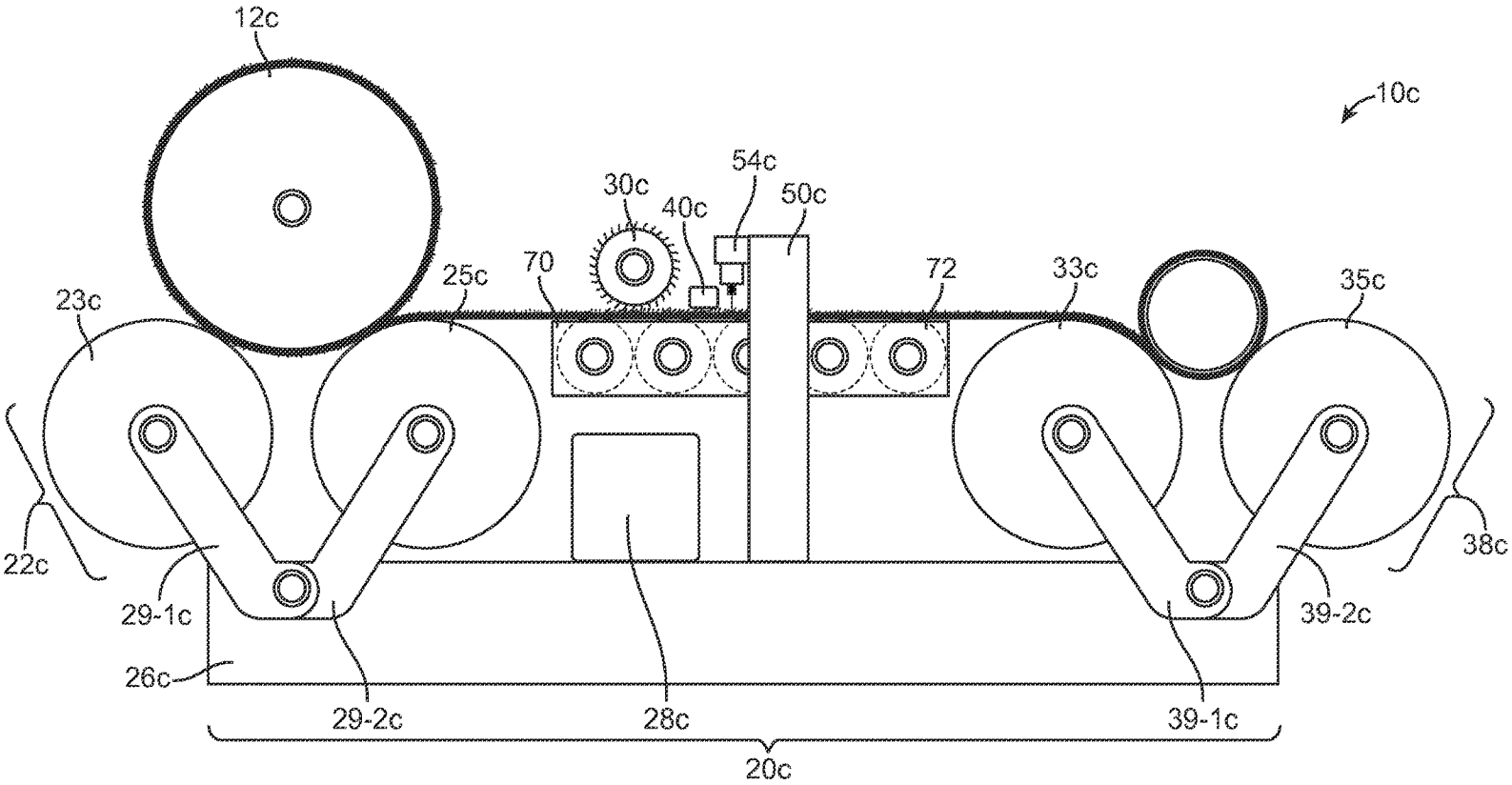
FIG. 7 is a side view of a preferred embodiment of an artificial turf trimmer wherein a roller bed is provided.
Figure 8:
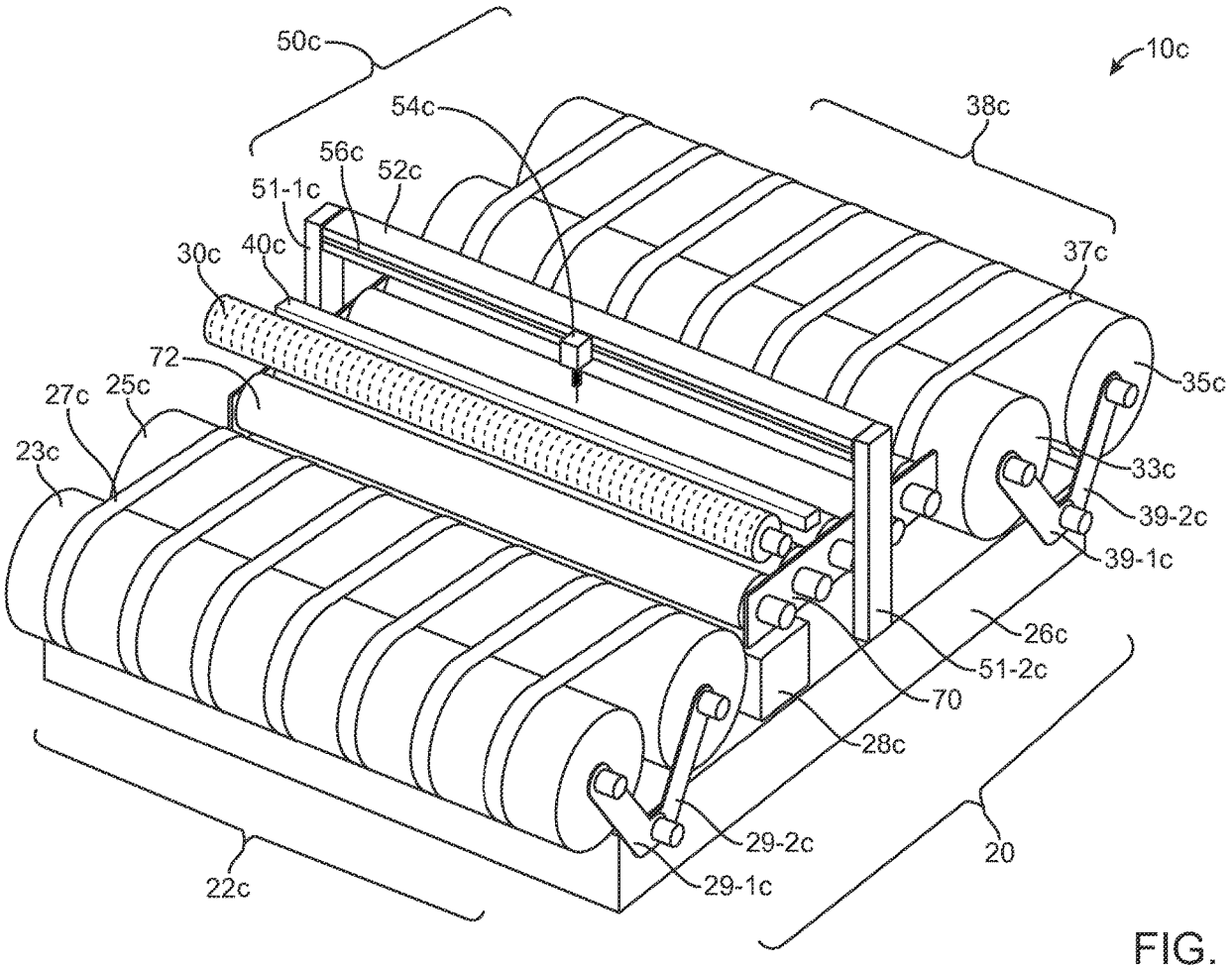
FIG. 8 is a perspective view the preferred embodiment of the artificial turf trimmer wherein the roller bed is provided.
Figure 9:
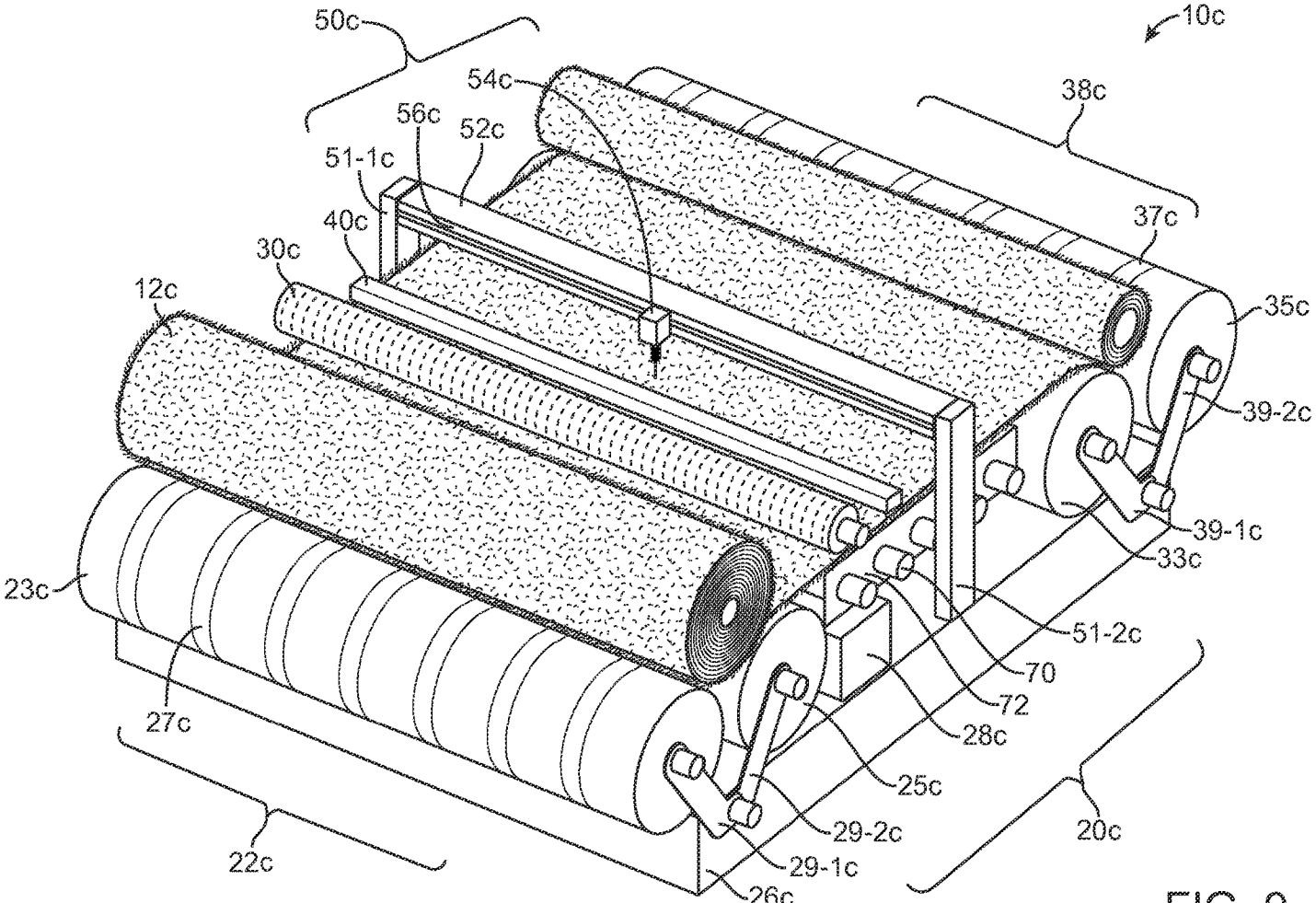
FIG. 9 is another perspective view the preferred embodiment of the artificial turf trimmer with artificial turf, wherein the roller bed is provided.

FIGS. 7-9 illustrate a third preferred embodiment of an artificial turf trimmer designated by a reference numeral 10*c*, where elements of similar structure are designated by the same reference numerals, followed by the lower case "c." In this embodiment, the artificial turf trimmer 10*c* generally may comprise a roller assembly 20*c*, a brush 30*c*, a vacuum pressure apparatus 40*c* and a trimming mechanism 50*c*.

Unlike the first and second preferred embodiments, the roller assembly 20*c* preferably comprises a load cradle 22*c*, a cutting table 70, a roll up cradle 38*c*, a chain drive 24*c* (not shown) housed inside a chain drive housing 26*c* to mechanically rotate the load cradle 22*c* and the roll up cradle 38*c*, and a motor 28*c* to supply power to the chain drive 24*c*. Preferably, the cutting table 70 comprises a roller bed which includes a plurality of hollow rolling tubes 72. As illustrated, the table 70 is horizontal above of and parallel to the chain drive housing 26*c*.

According to the preferred embodiment, a rolled artificial turf 12*c* to be trimmed is first placed on the load cradle 22*c*. The load cradle 22*c* may further comprise a first load cradle roller 23*c*, a second load cradle roller 25*c*, and a plurality of load cradle belts 27*c* wound around both the first load cradle roller 23*c* and the second load cradle roller 25*c*. The first load cradle roller 23*c* and the second load cradle roller 25*c* are further connected by a first pair of load cradle arms 29-1*c* and 29-2*c* on one end, and a second pair of load cradle arms 29-3*c* and 29-4*c* (not shown) on the other end. The load cradle arms 29-1*c* and 29-2*c* (as well as the load cradle arms 29-3*c* and 29-4*c* not illustrated in the drawings) are independently movable relative to each other and rotatable around a first axis 31*c*. Consequently, the distance between the first load cradle roller 23*c* and the second load cradle roller 25*c* can be adjusted to allow various rolled artificial turfs 12*c* of different diameters to be securely placed on the load cradle 22*c*. As each load cradle arm is independently movable, the load cradle arms 29-1*c*, 29-2*c*, 29-3*c* and 29-4*c* may be shuttled forward or backward for positioning, pivoted for squaring the rolled artificial turf 12*c*, and lowered to allow easy loading of the rolled artificial turf 12*c* onto the load cradle 22*c*. In a preferred embodiment, the load cradle arms 29-1*c*, 29-2*c*, 29-3*c* and 29-4*c* are pneumatically controlled. In an alternative embodiment, the load cradle arms 29-1*c*, 29-2*c*, 29-3*c* and 29-4*c* are manually adjusted by hand.

Similarly, the roll up cradle 38*c* may further comprise a first roll up cradle roller 33*c*, a second roll up cradle roller 35*c* and a plurality of roll up cradle belts 37*c* wound around both the first roll up cradle roller 33*c* and the second roll up cradle roller 35*c*. The first roll up cradle roller 33*c* and the second roll up cradle roller 35*c* are further connected by a first pair of roll up cradle arms 39-1*c* and 39-2*c* on one end, and a second pair of roll up cradle arms 39-3*c* and 39-4*c* (not shown) on the other end. Similar to the load cradle 22*c*, the roll up cradle arms 39-1*c* and 39-2*c* (as well as the load cradle arms 39-3*c* and 39-4*c* not illustrated in the drawings) are independently movable relative to each other and rotatable around a second axis 41*c*. Thus, the distance between the first roll up cradle roller 33*c* and the second roll up cradle roller 35*c* can be adjusted to allow various artificial turfs 12*c* of different diameters to be rolled and securely placed on the roll up cradle 28*c* after the damaged tips of the artificial turf 12*c* are trimmed. Further, as each roll up cradle arm is independently movable, the roll up cradle arms 39-1*c*, 39-2*c*, 39-3*c* and 39-4*c* may be shuttled forward or backward and lowered to allow easy unloading of the trimmed artificial turf 12*c* for further handling and packaging. In a preferred embodiment, the roll up cradle arms 39-1*c*, 39-2*c*, 39-3*c* and 39-4*c* are pneumatically controlled. In an alternative embodiment, the roll up cradle arms 39-1*c*, 39-2*c*, 39-3*c* and 39-4*c* are manually adjusted by hand.

As shown in FIG. 8, the trimming mechanism 50*c* may comprise a gantry 52*c* supported by a pair of tall vertical beams 51-1*c* and 51-2*c*, and a cutting apparatus 54*c*. The gantry 52*c* may include a track 56*c*, wherein the cutting apparatus 54*c* may move laterally in two dimensional plane and trim across the width of the artificial turf 12*c* during the trimming process. Preferably, the motor 28*c* supplies power to the gantry 52. In one preferred embodiment, the cutting apparatus 54*c* may comprise a laser cutter. In another preferred embodiment, the cutting apparatus may comprise a water jet cutter. As shown in FIGS. 8-9, in this third preferred embodiment of the artificial turf trimmer 10*c*, the aperture of the cutting apparatus 54*c* is oriented in a downward direction, such that the cutting apparatus 54*c* trims the damaged tips of the artificial turf 12*c* in a vertical (downward) direction, perpendicular to the stretched portion of the artificial turf 12*c* and the table 70.

A programmable logic controller (PLC) is preferably provided to control the entire operation of the artificial turf trimmer 10*c*. For instance, the PLC may concurrently monitor and control the machine runtime, the speed of the brush 30*c*, the speed of the roller assembly 20*c*, the pneumatic movements (lowering, raising or shuttling forward and backward) of the load cradle arms 29-1*c*, 29-2*c*, 29-3*c* and 29-4*c* and the roll up cradle arms 39-1*c*, 39-2*c*, 39-3*c* and 39-4*c*, the trimming speed of the cutting apparatus 54*c* and any other variables. According to a preferred embodiment, the PLC may allow a user to input the length of the artificial turf trimmer 12*c* to be trimmed to determine a proper runtime, or manually operate the artificial turf trimmer 10*c* according to various preset programs and settings. Further, in the preferred embodiment, the PLC indexes the artificial turf 12*c* one inch at a time to ensure that the artificial turf 12*c* remains tightly flat and the turf strands straight during the trimming process.

Prior to initiating the artificial turf trimmer 10*c*, the artificial turf 12*c* is loaded onto the load cradle 22*c*. One end of the artificial turf 12*c* is then pulled through the brush 30*c*, the vacuum pressure apparatus 40*c*, the cutting mechanism 50*c* and placed on the roll up cradle 38*c*. As illustrated in FIGS. 7 and 9, the length of the artificial turf 12*c* to be trimmed is laid flat on the table 70 and preferably stretched tight.

Subsequently, the PLC is then initiated to set the trimming program and activate the motor 28*c* and the chain drive 24*c*. The plurality of roll up cradle belts 37*c* and the plurality of load cradle belts 27*c* begin to simultaneously move in the same direction and rotate the first and second load cradle rollers 23*c* and 25*c*, as well as the first and second roll up cradle rollers 33*c* and 35*c*. As a result, the end of the artificial turf 12*c* on the roll up cradle 38*c* begins to roll and pull the rest of the artificial turf 12*c* through the brush 30*c*, the vacuum pressure apparatus 40*c* and the cutting mechanism 50*c* in a lateral direction. It is to be appreciated that in this preferred embodiment, the plurality of hollow rolling tubes 72 enables the flat portion of the artificial turf 12*c* to smoothly move along the roller bed 70 for trimming and subsequent rolling at the roll up cradle 38*c*.

The artificial turf 12*c* moves laterally in a continuous, conveyance manner and passes through the brush 30*c*. Preferably, the brush 30*c* is preset to rotate in the opposite direction of the artificial turf 12*c* to raise the strands of the artificial turf 12*c*.

As the artificial turf 12*c* continues to move along, it passes through the vacuum pressure apparatus 40*c* which applies vacuum to pull the raised turf strands to keep them straight, as well as to remove debris and smoke. Working in conjunction with the rollers, the vacuum apparatus 40*c* also maintains the artificial turf 12*c* tightly flat as it is being pulled. According to one embodiment, the vacuum apparatus 40*c* may comprise an elongated rectangular trough having a width of 0.25 inches to 0.5 inches and a length of 15 feet.

Simultaneously, while the strands of the artificial turf 12*c* are being pulled by the vacuum pressure, the cutting apparatus 54*c* begins to laterally move back and forth along the slot 56*c* and trim the damaged strands of the artificial turf 12*c*. In the embodiment that utilizes the laser cutter as the cutting apparatus 54*c*, the trimming is preferably done by using the high power, $CO_2$ laser to cut the tips of the artificial turf 12*c* as described above. Alternatively, the Galvo laser ablation technique described above may also be used. In yet another alternative embodiment, other laser ablation techniques known in the art may also be used.

The artificial turf 12*c* with trimmed strands then continues to be pulled and rolled at the roll up cradle 38*c*. After the entire artificial turf 12*c* has been trimmed, the now rolled up artificial turf 12*c* is then unloaded from the roll up cradle 38*c* for further handling.

Figure 10:
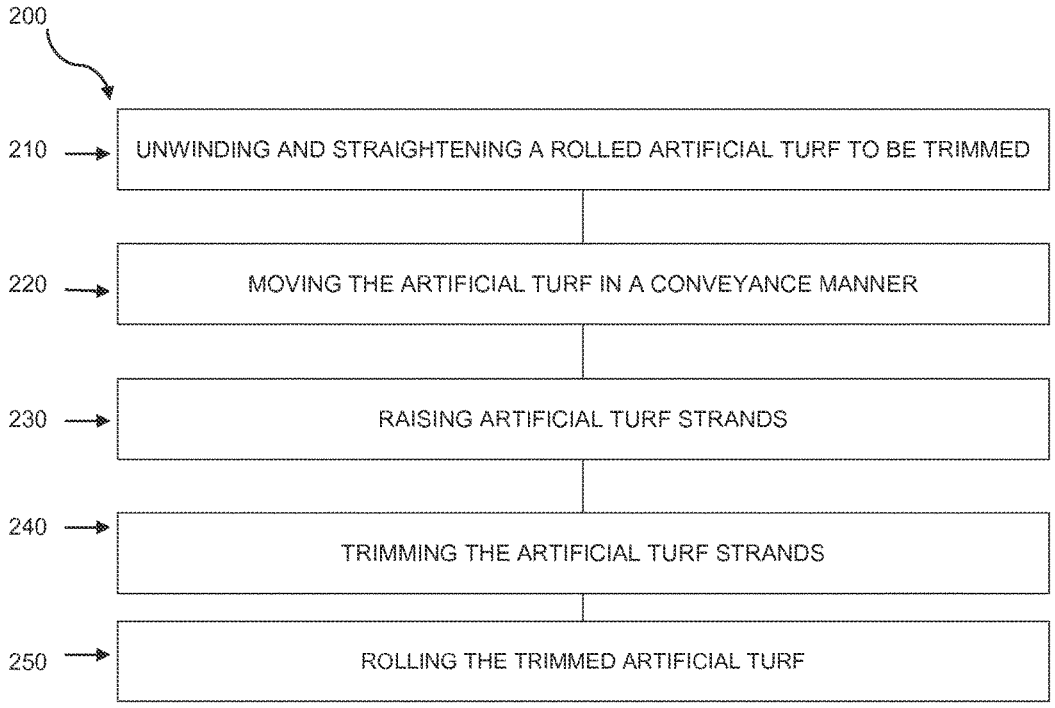
FIG. 10 is a diagram of a preferred method to trim an artificial turf using an artificial turf trimmer.

FIG. 10 illustrates a preferred method 200 for trimming an artificial turf using an artificial turf trimmer. The method 200 may comprise a step 210 of unwinding and straightening a rolled artificial turf to be trimmed, a step 220 of moving the artificial turf in a conveyance manner, a step 230 of raising the artificial turf strands, a step 240 of trimming the artificial turf strands, and a step 250 of rolling the trimmed artificial turf.

The step 210 of unwinding and straightening a rolled artificial turf to be trimmed may further comprise placing the rolled artificial turf onto a load cradle having adjustable arms to allow shuttling forward or backward and lowering for easy loading of the trimmed artificial turf, unwinding the rolled turf, pulling one end of the turf through a brush and a series of rollers at a vertical angle, and placing the end of the turf on a roll up cradle to ensure that the artificial turf is tightly flat.

In an alternative embodiment, the step 210 may comprise placing the rolled turf onto the load cradle, unwinding the rolled turf, placing the unwound portion of the turf on a cutting table at a horizontal plane and placing one end of the turf on a roll up cradle.

The step 220 of moving the artificial turf in a conveyance manner may further comprise providing a chain drive connecting the load cradle and the roll up cradle, providing a motor to supply power to the chain drive, providing a programmable logic controller (PLC) to operate the chain drive, the load cradle and the roll up cradle, and operating the assembly according to a preset program and settings. In a preferred embodiment, the step 220 may further comprise setting the PLC to index the artificial turf one inch at a time to ensure that the artificial turf remains tightly flat during the trimming process.

The step 230 of raising the artificial turf strands may further comprise pulling the turf through a brush and applying vacuum pressure to keep the turf strands straight. In a preferred embodiment, a vacuum apparatus is provided. Preferably, a suitable vacuum apparatus may comprise an elongated rectangular trough having a width of 0.25 inches to 0.5 inches and a length of 15 feet.

The step 240 of trimming the artificial turf strands may further comprise providing a laser cutting mechanism that includes a motor, a gantry and a laser cutter connected to the gantry that is laterally movable in a two dimensional plane along a track in the gantry for precise trimming while vacuum pressure is maintained.

In the preferred embodiment, the laser cutter may further comprise a carbon dioxide ($CO_2$) laser, wherein a beam of infrared light precisely cuts the tips of the strands in a very small cutting area.

In another embodiment, the laser cutter may further comprise a Galvo vaporization laser, wherein a high repetition, high power, rapid pulse laser curtain is generated normal to the tips of the turf strands to be trimmed, heats the surface of the tips of the turf strands to a boiling point, erodes the thermoplastic material and evaporates the undesired tips of the turf strands.

In yet another preferred embodiment, the step 240 may further comprise providing a water jet cutting mechanism that includes a motor, a gantry and a water jet cutter connected to the gantry that is laterally movable in a two dimensional plane along a track in the gantry.

The step 250 of rolling the trimmed artificial turf may comprise pulling and rolling the trimmed turf at the roll up cradle. After the entire artificial turf has been trimmed, the rolled up artificial turf is then unloaded from the roll up cradle for further handling.

It shall be appreciated that all of the embodiments described above can be used to trim regular carpets of various lengths (heights), styles and materials as well, including, but not limited to, cut pile, level loop, multi-level or patterned loop pile, cut-loop pile, and (Frieze) twist style carpets. Further, without limitation, artificial turf and carpets having widths of up to 15 feet were able to be trimmed according to some of the embodiments described above.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An artificial turf trimming device comprising:

a roller assembly configured to unwind a rolled artificial turf;

a brush contacting artificial turf as it is unwound;

a vacuum pressure apparatus applying a vacuum on a surface of the artificial turf subsequent to contacting the brush; and a trimming mechanism to trim end portions of strands of the artificial turf raised by at least one of the brush and the vacuum pressure apparatus.

2. The trimming device of claim 1, further comprising a programmable logic controller.

3. The trimming device of claim 1, wherein the roller assembly further comprises:

a load cradle receiving the rolled artificial turf;

a first vertical roller about which the artificial turf moves during trimming of the end portions;

a second vertical roller;

a third vertical roller, the second vertical roller and the third vertical roller disposed to receive the artificial turf subsequent to trimming thereof and to maintain tension on the artificial turf;

a roll up cradle receiving the artificial turf after being directed thereto by the third vertical roller;

a chain drive operable to rotate the load cradle and the roll up cradle; and a motor operable to drive the chain drive.

4. The trimming device of claim 1, wherein the trimming mechanism further comprises a gantry, a motor and a laser cutter movable along a track in the gantry.

5. The trimming device of claim 1, wherein the trimming mechanism further comprises a gantry, a motor and a water jet cutter movable along a track in the gantry.

6. The trimming device of claim 1, wherein an aperture of the trimming mechanism is oriented in a horizontal direction.

7. The device of claim 1, wherein an aperture of the trimming mechanism is oriented in a vertical direction.

8. An artificial turf trimming device, comprising:

a roller assembly configured to unwind a rolled artificial turf;

a cutting table receiving artificial turf as it is unwound by the roller assembly;

a brush configured to contact the artificial turf prior to trimming;

a vacuum pressure apparatus applying a vacuum on a surface of the artificial turf subsequent to contacting the brush; and a trimming mechanism to trim end portions of strands of the artificial turf raised by at least one of the brush and the vacuum pressure apparatus.

9. The trimming device of claim 8, further comprising a programmable logic controller.

10. The trimming device of claim 8, wherein the roller assembly further comprises a load cradle receiving the rolled artificial turf;

a roll up cradle receiving trimmed artificial turf after being trimmed by the trimming mechanism;

a chain drive driving the load cradle and the roll up cradle; and a motor driving the chain drive.

11. The trimming device of claim 8, wherein the trimming mechanism further comprises a gantry, a motor and a laser cutter movable along a track in the gantry.

12. The trimming device of claim 8, wherein the trimming mechanism further comprises a gantry, a motor and a water jet cutter movable along a track in the gantry.

13. The device of claim 8, wherein an aperture of the trimming mechanism is oriented in a vertical direction.

14. A method for trimming an artificial turf strands comprising:

unwinding and straightening a rolled artificial turf to be trimmed;

raising the artificial turf strands;

trimming the artificial turf strands; and rolling the trimmed artificial turf.

15. The method of claim 14, wherein the step of unwinding and straightening a rolled artificial turf to be trimmed further comprises:

placing the rolled artificial turf onto a load cradle having adjustable arms to allow shuttling forward or backward and lowering for easy loading of the trimmed artificial turf;

unwinding the rolled turf;

pulling one end of the turf through a brush and a series of rollers at a vertical angle; and placing the end of the turf on a roll up cradle.

16. The method of claim 15, wherein the step of moving the artificial turf in a conveyance manner further comprises:

providing a chain drive connecting the load cradle and the roll up cradle;

providing a motor to supply power to the chain drive;

providing a programmable logic controller (PLC) to operate the chain drive, the load cradle and the roll up cradle; and operating the chain drive, the load cradle, the roll up cradle and the motor according to a preset program and settings.

17. The method of claim 14, wherein the step of unwinding and straightening a rolled artificial turf to be trimmed further comprises:

placing the rolled turf onto a load cradle;

unwinding the rolled turf;

placing the unwound portion of the turf on a cutting table at a horizontal plane; and placing one end of the turf on a roll up cradle.

18. The method of claim 14, wherein the step of raising the artificial turf strands further comprises pulling the turf through a brush and applying vacuum pressure to keep the turf strands straight.

19. The method of claim 14, wherein the step of trimming the artificial turf strands further comprises providing a laser cutting mechanism that includes a motor, a gantry and a laser cutter connected to the gantry that is laterally movable in a two dimensional plane along a track in the gantry.

20. The method of claim 14, wherein the step of trimming the artificial turf strands may further comprise providing a water jet cutting mechanism that includes a motor, a gantry and a water jet cutter connected to the gantry that is laterally movable in a two dimensional plane along a track in the gantry.

* * * * *